US005632200A

United States Patent [19]

Fukai

[11] Patent Number: 5,632,200

[45] Date of Patent: May 27, 1997

[54] STENCIL DISCARDING APPARATUS AND PROCESS ACCOMMODATING DIFFERENT LENGTH STENCILS

[75] Inventor: Shigeki Fukai, Tokyo, Japan

[73] Assignee: Riso Kagaku Corporation, Tokyo, Japan

[21] Appl. No.: 518,837

[22] Filed: Aug. 24, 1995

[30] Foreign Application Priority Data

Aug. 25, 1994 [JP] Japan ..... 6-200844

[51] Int. Cl.[6] ..... B41L 13/06

[52] U.S. Cl. ..... 101/116; 101/114; 101/129

[58] Field of Search ..... 101/114, 116, 101/117, 118, 119, 120, 128.4, 129, 477, 484

[56] References Cited

U.S. PATENT DOCUMENTS

| | | | |
|---|---|---|---|
| 5,165,338 | 11/1992 | Okazaki et al. | 101/118 |
| 5,487,333 | 1/1996 | Oshio et al. | 101/116 |
| 5,517,913 | 5/1996 | Oshio et al. | 101/119 |
| 5,537,920 | 7/1996 | Hasegawa et al. | 101/116 |

FOREIGN PATENT DOCUMENTS

| | | | |
|---|---|---|---|
| 607699 | 7/1994 | European Pat. Off. . | |
| 195885 | 8/1986 | Japan | 101/114 |
| 62-28758 | 6/1987 | Japan . | |
| 4-46236 | 7/1992 | Japan . | |
| 2208279 | 3/1989 | United Kingdom . | |

OTHER PUBLICATIONS

Patent Abstracts of Japan, vol. 4, No. 64 (M-011), May 14,1980 & JP-A-55 030922 (Ricoh Co., Ltd), Mar. 5, 1980.

*Primary Examiner*—Stephen R. Funk
*Attorney, Agent, or Firm*—Sughrue, Mion, Zinn Macpeak & Seas

[57] ABSTRACT

A stencil-making-type printing machine in which, even if rotary cylindrical drums having printing regions of different sizes are frequently used while being replaced with one another, the machine accurately detects when a used-stencil accommodating box is filled with used stencil, and notifies the operator. In the stencil-making-type printing machine, a CPU 200 determines the type of a rotary cylindrical drum loaded therein from output signals of dip switches 133 and 135 which are applied to it through electrical connectors 137 and 139. When a stencil discharging operation is carried out according to the type of the rotary cylindrical drum thus determined, the CPU 200 operates to add a numerical value corresponding to the length of a used stencil removed from the drum to the result of the previous addition stored in a RAM 202 to obtain the latest result of addition, and to compare the latest result of addition thus obtained with a fill-up reference data indicating that a used-stencil accommodating box is filled up with used stencil. When the latest result of addition reaches the fill-up reference data, the CPU 200 applies an instruction signal to a display drive circuit 170 to cause a display section 16 to display the fact that the used-stencil accommodating box is filled with used stencils.

8 Claims, 8 Drawing Sheets

STENCIL DISCARDING APPARATUS AND PROCESS ACCOMMODATING DIFFERENT LENGTH STENCILS

BACKGROUND OF THE INVENTION

Field of the Invention

This invention relates to a stencil-making type printing machine in which rotary cylindrical drums having different printing regions are individually mounted depending on the stencil size. A stencil printing operation is carried out with a printing stencil wound on the drum which is obtained by cutting a belt-shaped stencil paper provided in the form of a roll in which letters, designs, etc. have been perforated. Before the printing operation is performed with a new printing stencil, the used printing stencil is removed from the rotary cylindrical drum and discharged into a used-stencil accommodating box.

Background

Heretofore, for instance in the case where a printing operation is carried out using a rotary cylindrical drum having a printing region which is substantially equal to (or slightly larger than) the sheet size A3, the printing stencil is formed as follows. If an original to be printed or a printing sheet to be used is smaller than sheet size A3, the printing stencil wound on the drum is never adjusted to be smaller than A3 when it is cut; that is, the size of the printing stencil is constant at all times, corresponding to sheet size A3. Hence, in the case where a printing machine of this type is used to form a small number of prints, the cost of the stencil paper most significantly affects the printing cost per print.

In order to solve this problem, a stencil printing machine has been proposed in the art which is designed as follows. The machine uses two different rotary cylindrical drums; for instance a rotary cylindrical drum having a printing region corresponding to sheet size A3 (hereinafter referred to as "an A3-size drum", when applicable) and a rotary cylindrical drum having a printing region corresponding to sheet size A4 (hereinafter referred to as "an A4-size drum", when applicable), thereby to decrease the length of a printing stencil as much as possible which is to be formed according to the size of an original or printing sheet to be used.

In the stencil printing machine of this type, one of the rotary cylindrical drums is selected according to the size of an original or printing sheet to be used, and the length of the printing stencil is changed according to the rotary cylindrical drum thus selected. Hence, the above-described problem can be solved with the provision of the stencil printing machine.

On the other hand, in the printing machine, in order to detect when the used-stencil accommodating box is filled up with used stencils, switching means is provided which is operated according to the quantity of used stencils in the used-stencil accommodating box. The switching means does not experience any problem.

However, some printing machines are designed so that discharged stencils are counted, and when the count value reaches a predetermined value indicating that the used-stencil accommodating box is filled, such a condition is communicated to the operator by means of a signal. However, this results in a problem because the length of a printing stencil depends on the rotary cylindrical drum selected.

With the length of a stencil for the A3-size drum as a reference, the maximum number of used stencils to be accommodated in the used-stencil accommodating box may be experimentally determined as numerical data, so that, when the count value reaches the numerical data thus determined, an alarm is given to the operator. If, in this case, only the A3-size drum is used until the numerical data is reached, the alarm accurately represents the fact that the used-stencil accommodating box is full of used stencils. However, in the case where the A4-size drum which is smaller in printing region than the A3-size drum is more frequently used than the A3-size drum, the above-described alarm may be a false alarm; that is, the time of production of the alarm is not coincident with the time instant that the used-stencil accommodating box is filled with used stencils; in other words, the alarm is sounded even though the box is not yet full. The frequency of discharging the used stencils from the box is correspondingly increased.

On the other hand, with the length of a stencil wound on the A4-size drum as a reference, the maximum number of used stencils to be accommodated in the used-stencil accommodating box may be experimentally determined as a fill-up reference data, so that, when the count value reaches the fill-up reference data thus determined, an alarm is given to the operator. If, in this case, only the A4-size drum is used until the fill-up reference data is reached, the alarm accurately represents the fact that the used-stencil accommodating box is full. However, in the case where the A3-size drum which uses a printing stencil longer than a printing stencil used by the A4-size drum is more frequently used, then the above-described alarm may be a false alarm; that is, the time of production of the alarm is not coincident with the time instant that the used-stencil accommodating box is filled with used stencils; in other words, the box is filled with used stencils prior to the sounding of the alarm. As a result, the used stencil is removed in an unacceptable manner.

In view of the foregoing, an object of the invention is to provide a stencil-making-type printing machine in which, even if rotary cylindrical drums having printing regions of different sizes are frequently replaced with one another, it can be accurately detected whether or not the used-stencil accommodating box is filled with used stencils, whereby the stencil paper is economically used, and in which, after the stencil forming operation a series of operations up to the used-stencil accommodating operation are carried out with high efficiency.

SUMMARY OF THE INVENTION

The foregoing object of the invention has been achieved by the provision of a stencil-making-type printing machine in which plural types of rotary cylindrical drums having printing regions of different size can be loaded one at a time, in which a stencil paper provided in the form of a roll is cut according to the printing region of the cylindrical drum loaded therein to form a printing stencil, and a printing operation is carried out with the printing stencil wound on the drum, and before a printing operation is carried out for a new original, a used stencil is separated from the rotary cylindrical drum and discarded into a used-stencil accommodating box.

The printing machine includes detecting means for detecting the type of a rotary cylindrical drum loaded in the machine; memory means for storing as addition data a numerical value corresponding to the length of the used stencil which is discarded in the used-stencil accommodating box; control means which adds addition data corresponding to the length of a used stencil which is separated from a rotary cylindrical drum the type of which is detected by the drum type detecting means, to the result of the previous addition which has been made, to obtain the latest result of addition (i.e., to store the total length of used stencil that has been removed), and causes the memory means to store the latest result of addition thus obtained, and determines whether or not the latest result of addition reaches a predetermined value; and notifying means which, when the latest result of addition reaches the predetermined value, notifies the user that the used-stencil accommodating box is filled up with used stencils.

The printing machine further comprises box detecting means for detecting whether or not the used-stencil accommodating box is at a predetermined position, so that the control means operates to reset, in response to a detection signal which the box detecting means outputs when the used-stencil accommodating box is removed from the predetermined position, the result of addition which has been stored in the memory means. That is, when an empty box is loaded the memory means is reset to zero.

According to another embodiment, the printing machine further comprises box detecting means for detecting whether or not the used-stencil accommodating box is at a predetermined position, and stencil detecting means which, when the used-stencil accommodating box is set at the predetermined position, determines whether or not a used stencil is present in the used-stencil accommodating box, so that the control means operates to reset, in response to both a detection signal which the box detecting means outputs when the used-stencil accommodating box is removed from the predetermined position and a detection signal which the stencil detecting means outputs when no used stencil is present in the used-stencil accommodating box set at the predetermined position, the result of addition which has been stored in the memory means.

In the printing machine, each rotary cylindrical drum is rotatably supported by its own drum support, and is replaceably loaded in the printing machine body together with the drum support, the drum support having an information providing section which indicates the type of rotary cylindrical drum, so that the type of the rotary cylindrical drum is identified from information given by the information providing section.

In the printing machine, the information providing section provided for the drum support comprises dip switches having switching states which depend on the type of the rotary cylindrical drum.

The printing machine further comprises a shielding member detachably mounted on the peripheral edge of each rotary cylindrical drum; and shielding-member detecting means for detecting the passage of the shielding member as the rotary cylindrical drum turns, so that the control means operates to cut the stencil paper in response to a detection signal which the shielding-member detecting means outputs upon detection of the passage of the shielding member.

The stencil-making-type printing machine operates as follows. When the type of a rotary cylindrical drum loaded in the machine is detected, and the stencil discharging operation is started according to the type of the drum thus detected, the control means operates to add the addition data corresponding to the length of the used stencil which is separated from the rotary cylindrical drum loaded in the printing machine body to the result of the previous addition value, to obtain the latest result of addition, and causes the memory means to store the latest result of addition thus obtained. When the latest result of addition reaches a predetermined value indicating that the used-stencil accommodating box is filled with used stencils, the control means notifies this fact to the operator. Hence, even if replacement of the rotary cylindrical drum is frequently carried out; that is, even if used stencils different in length are discharged, it can be positively detected when the used-stencil accommodating box is filled with used stencils, and the operator can be immediately signalled.

The box detecting means detects whether or not the used-stencil accommodating box is at the predetermined position, and the result of addition which has been stored in the memory means is reset in response to the detection signal which the box detecting means outputs when the used-stencil accommodating box is removed from the predetermined position.

The stencil detecting means determines whether or not a used stencil is present in the used-stencil accommodating box when the used-stencil accommodating box is set at the predetermined position, and the result of addition which has been stored in the memory means is reset in response to both the detection signal which the box detecting means outputs when the used-stencil accommodating box is removed from the predetermined position and the detection signal which the stencil detecting means outputs when no used stencil is present in the used-stencil accommodating box set at the predetermined position.

In the printing machine each rotary cylindrical drum is rotatably supported by its own drum support, and is replaceably loaded in the printing machine body together with the drum support. The drum support has an information providing section which indicates the type of the rotary cylindrical drum, so that the type of the rotary cylindrical drum is identified from information given by the information providing section. The information providing section, comprises the dip switches having switching states which depend on the type of the rotary cylindrical drum. The control means detects the type of the rotary cylindrical drum from the switching states of those dip switches.

The stencil paper is cut in response to the detection signal which the shielding-member detecting means outputs upon detection of the passage of the shielding member. Hence, by shifting the position of the shielding member, the length, to which the stencil paper should be cut can be set to a value which is most suitable for the rotary cylindrical drum. That is, the stencil paper can be used economically.

DETAILED DESCRIPTION OF THE PREFERRED EMBODIMENTS

Figure 1:
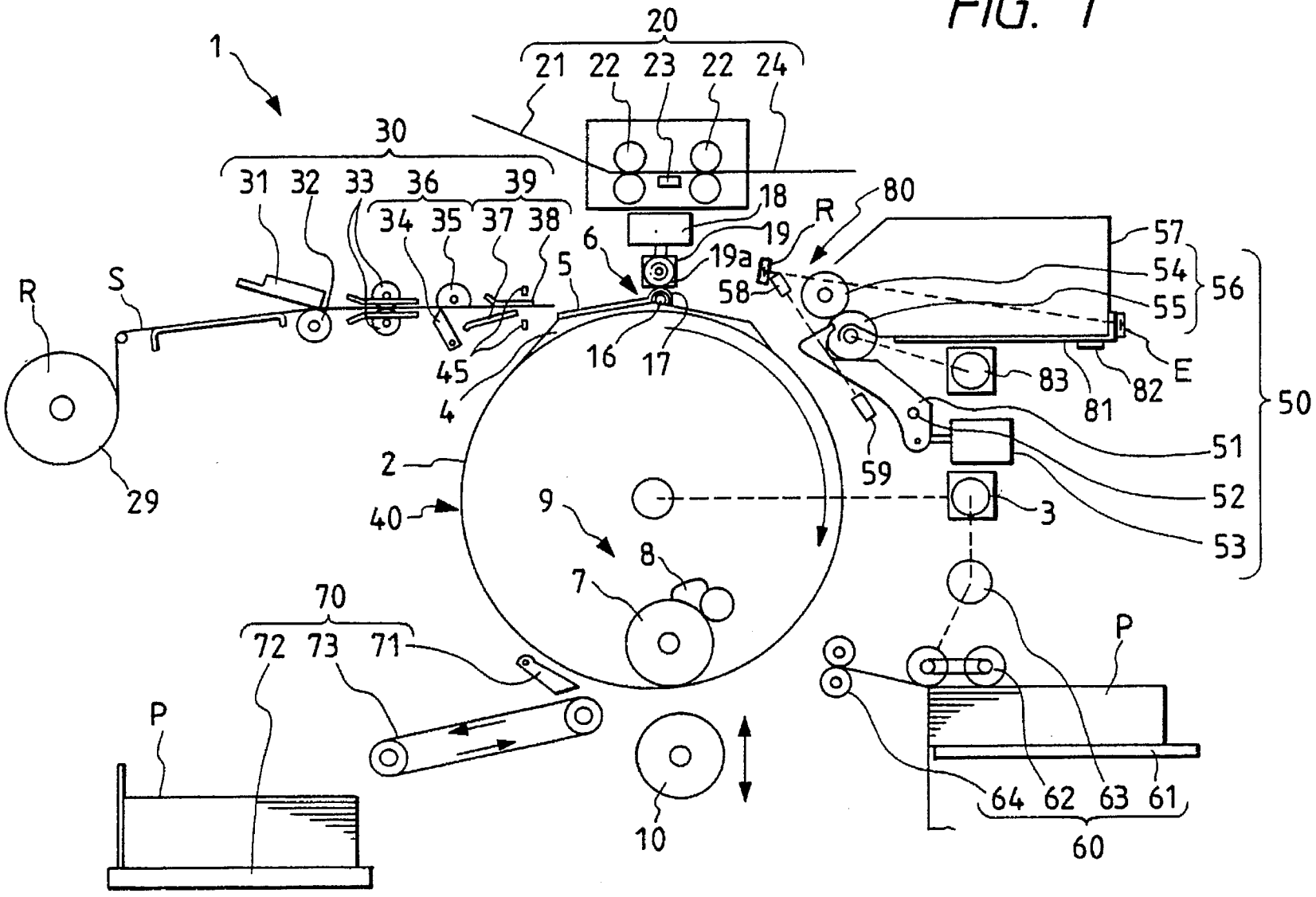
FIG. 1 is an explanatory diagram showing the arrangement of an example of a stencil-making-type printing machine according to the invention.

FIG. 1 shows a stencil printing machine, which constitutes an embodiment of the invention. The machine 1 comprises an original image reading section 20, a heat-sensitive type stencil making section 30, a stencil printing mechanism section 40, a stencil discharging section 50, a sheet supplying section 60, and a sheet discharging section 70.

The original image reading section 20, as shown in FIG. 1, comprises an original placing stand 21 on which an original to be printed out is placed, a pair of original conveying rollers 22 for conveying an original from the original placing stand 21, a contact type image sensor 23 which optically reads the image of an original and converts it into an electrical signal, and an original discharging tray 24 on which originals read by the image sensor 23 are stacked.

The original image reading section 20 starts its operation when, after an original is set on the original placing stand 21, a stencil formation start button on an operating panel 150 (described later) is depressed.

The stencil making section 30 comprises a thermal head 31 having a number of heat generating elements which are paired vertically and arranged in a direction perpendicular to the surface of the drawing and a platen roller 32 confronted with the thermal head 31. A stencil paper roll holding section 29 is provided on the left side of the stencil making section 30 as viewed in FIG. 1. The section 29 holds a roll R of stencil paper which is formed by winding a belt-shaped heat-sensitive stencil paper S. In the section 29, the roll can be replaced with another when necessary. Downstream of the thermal head 31 and the platen roller 32, a pair of stencil paper conveying rollers 33 arranged vertically, a stencil paper cutter 36, and a stencil guide board assembly 39 are provided. The stencil paper cutter 36 consists of a stationary blade 34 and a movable blade 35 provided above the stationary blade, to cut the stencil paper S in which the image of an original has been perforated, to form a printing stencil. The stencil guide board assembly 39 comprises a lower guide board 37 and an upper guide board 38, for conveying the stencil paper S to a clamping section 6 on a rotary cylindrical drum 2 (described below).

In the stencil making section 30, the stencil paper S fed out of the stencil paper roll holding section 29 is conveyed by the platen roller 31 and the pair of stencil paper conveying rollers 33, and the image of a given original is thermally perforated in it with the thermal head. The stencil paper S is further fed during perforating, and the leading edge thereof is clamped by the drum 2. The stencil paper S is being wound on the drum 2 in part. The printing stencil S fully perforated is cut with the stencil paper cutter 36, and completely wound on the drum 2.

The stencil making section 30 further comprises a stencil paper holding sensor 45 which is used in order that, after a printing stencil is formed by cutting the stencil paper S with the stencil paper cutter 36, the leading edge of the stencil paper S thus cut is conveyed over the stencil paper cutter 36 to a predetermined position on the stencil guide board assembly 39, and the stencil paper S is held there until the next stencil making operation starts. That is, the stencil paper holding sensor 45 detects the leading edge of the stencil paper S which has been cut in the above-described manner. Upon detection of the leading edge of the stencil paper, the platen roller 32 and the pair of stencil paper conveying rollers 33 are rotated until the leading edge of the stencil paper S is conveyed a predetermined distance. The heat generating elements of the thermal head 31 generate heat according to the image Signal outputted by the image sensor 23 in the original image reading section 20, so that the image of the original is perforated in the stencil paper S.

As shown in FIG. 1, the stencil printing mechanism section 40 has the rotary cylindrical drum 2 which is rotated around its central axis. The drum 2 is rotated clockwise (in FIG. 1) by a main motor 3. The cylindrical wall of the drum 2 has an ink passage structure serving as a printing region (hereinafter "ink passage region" when applicable), and an ink non-passage region surrounding the ink passage region. In the drum 2 which is for sheet size A3, the ink passage region is, for instance, 300 mm in axial length, and 440 mm in circumferential length; and in the drum 2 which is for sheet size A4, its ink passage region is, for instance, 300 mm in axial length, and 220 mm in circumferential length.

A stage member 4 is provided on the outer surface of the ink non-passage region of the cylindrical wall of the drum in such a manner that it is extended in the direction of the generating line of the cylindrical wall. On the stage member 4, a stencil clamping board 5 is provided to cooperate with the stage member 4 to clamp one end of a stencil paper S. The stencil clamping board 5 is mounted on a shaft 16 with a gear 17. A clamp solenoid 18 is provided on a machine body frame (not shown) which is stationary. The clamp solenoid 18 is adapted to move a clamp drive unit 19 vertically which is made up of a drive gear **19*a*, and a clamp motor (not shown) adapted to rotate the drive gear 19*a*, so as to selectively engage the latter 19*a* with the gear 17 of the shaft 16**.

The drive gear **19*a* thus engaged with the gear 17 is rotated with the motor, so that the stencil clamping board 5 is rotated approximately 180° on the stage member 4 of the drum 2. More specifically, the stencil clamping board 5 is rotated about the shaft 16 between a clamp position (shown in FIG. 1) where it cooperates with the stage member 4 to clamp one end of the stencil paper which is transferred from the stencil making section 30**, and a non-clamp position which is spaced angularly about 180° from the clamp position.

An ink supplying mechanism 9 including a squeegee roller 7 and a doctor rod 8 is provided inside the rotary cylindrical drum 2. A press roller 10 is provided below the drum 1 in such a manner that it is vertically movable. The press roller 10 pushes the printing sheet P against the rotary cylindrical drum 2 which is supplied in synchronization with the rotation of the latter 2, so that the printing ink supplied through the ink passage region of the rotary cylindrical drum 2 and the perforating region of the stencil is transferred onto the printing sheet P.

Figure 2:
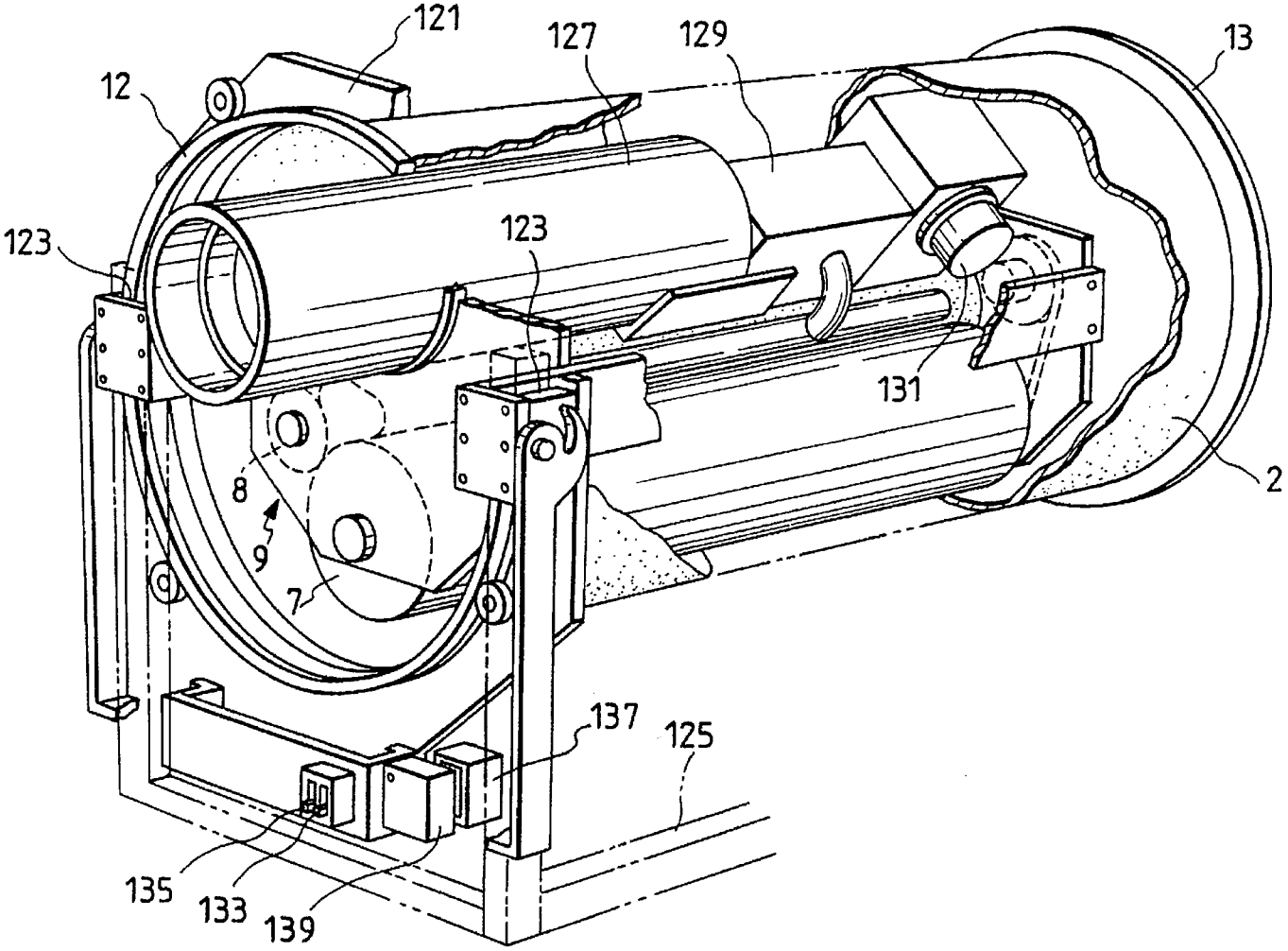
FIG. 2 is a perspective view, with parts cut away, showing the structure of a rotary cylindrical drum in the printing machine.

The structure of the rotary cylindrical drum 2 will be described in more detail. As shown in FIG. 2, the drum 2 is rotatably supported by a drum support 121; that is the drum 2 and the drum support 121 are provided as a unit which is rotatably supported by a supporting board on which engaging sections 123 are formed. With the aid of engaging sections 123 formed on the drum support 121, the unit is detachably engaged with a movable drum supporting frame 125 which may be moved into and out of the printing machine 1. Hence, in order to replace the drum 2, the unit is drawn out of the printing machine with the aid of the movable drum supporting frame 125. An ink bottle 127 containing printing ink, an ink-supplying pump 129 for supplying printing ink to the ink supplying section 9, and an ink-supplying-pump driving motor 131 are fixedly provided inside the rotary cylindrical drum 2.

Figure 3A:
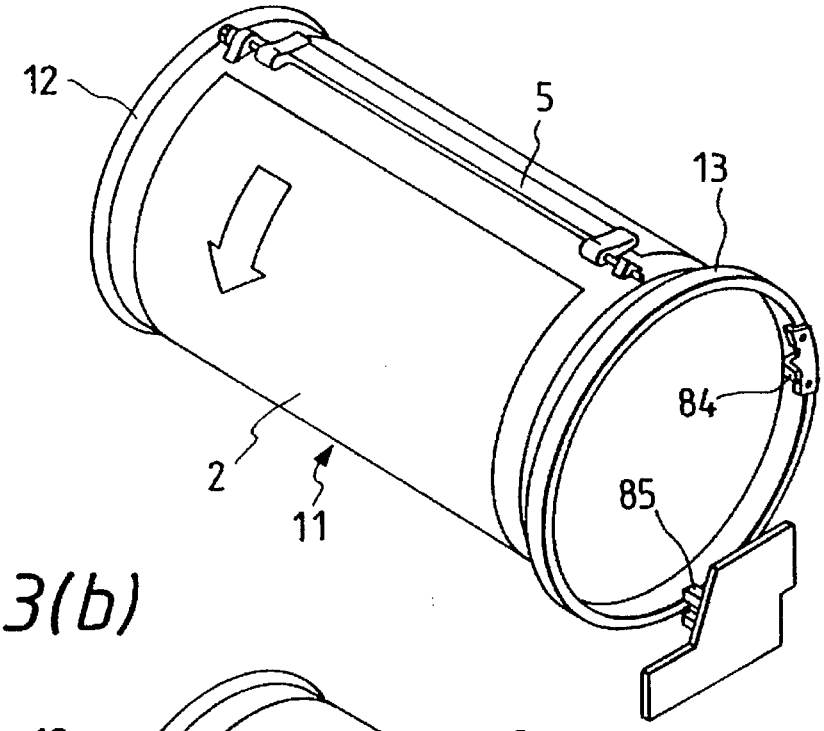
FIG. 3(*a*) is a perspective view showing a drum rotational position sensor mounted on the rotary cylindrical drum in the printing machine which is adapted to output a timing signal for a stencil paper cutter, FIG. 3(*b*) is a perspective view showing the rotational position of the rotary cylindrical drum at the time instant that the drum rotational position sensor outputs a detection signal and FIG. 3(*c*) is an enlarged perspective view showing the drum rotational position sensor.
Figure 3B:
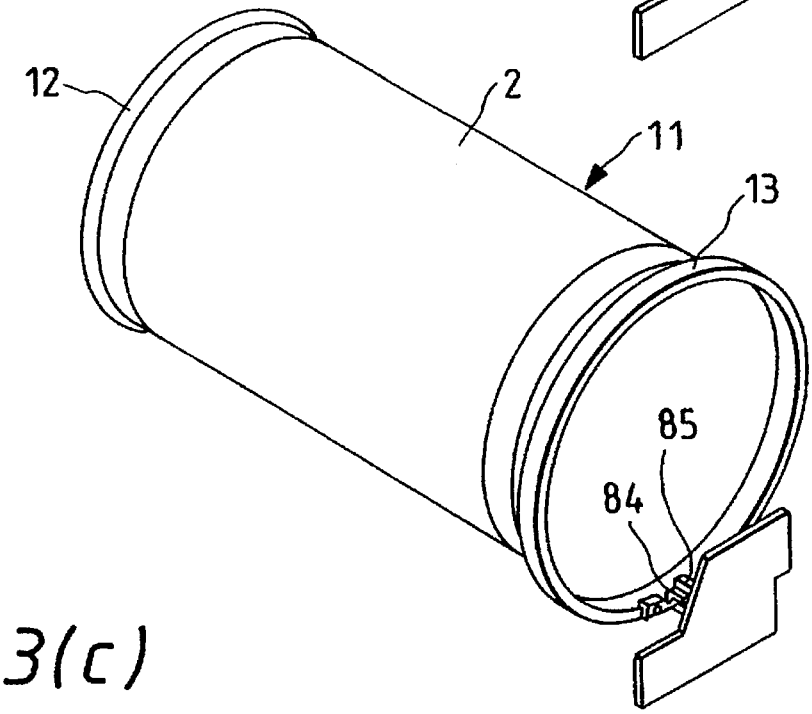
Figure 3C:
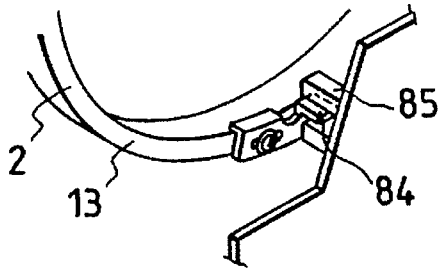

Among the rotary cylindrical drums 2, the one most suitable for a given printing operation is loaded in the printing machine 1. The rotary cylindrical drums are different in printing region; for instance one of the drums has a printing region corresponding to sheet size A3, and another has a printing region corresponding to sheet size A4; however, they are all equal in diameter and in axial length to one another. As shown in FIG. 3, the drum 2 is made up of a cylindrical wall 11, and a pair of rigid flanges 12 and 13 fixedly fitted in both ends of the cylindrical wall 11 with fixing means such as screws. Thus, the resultant drum 2 is cylindrical as a whole. One or two screens are wound on the outer cylindrical surface of the drum 2 to uniformly disperse the printing ink which is supplied thereto from inside. In addition, as shown in FIG. 3, a shielding board 84 is provided on one of the flanges 12 and 13, to determine the length to which the stencil paper S is to be cut (the length of a printing stencil which is to be wound on the drum Furthermore, as shown in FIG. 3, a drum rotational position sensor 85 is fixedly mounted on the machine body. The sensor 85 operates as follows. First, the drum 2 is so positioned that the clamping section 6 is located at the top. Under this condition, the drum 2 is turned. When, in this operation, the sensor 85 detects the passage of the shielding board 84, the stencil paper cutter 36 is operated to cut the stencil paper S.

As is apparent from the above description, by changing the position of the shielding board 84 according to the type of a given rotary cylindrical drum 2, the length to which the stencil paper should be cut can be determined. For instance in the case where the size-A3 drum 2 is employed, the shielding board 84 is so positioned that the stencil paper S is cut to a predetermined length longer than the ink passage region of the drum 2 which corresponds to sheet size A3; and in the case where the size-A4 drum 2 is employed, similarly the shielding board 84 is so positioned that the stencil paper S is cut to a predetermined length longer than the ink passage region of the drum 2 which corresponds to sheet size A4. More specifically, in the case where the size-A3 drum 2 is employed, the stencil paper S is cut to form a printing stencil 320 mm×515 mm; and in the case where the size-A4 drum is employed, the stencil paper S is cut to form a printing stencil 320 mm×310 mm.

A shielding board (not shown) different from the above-described shielding board 84 is mounted on the edge of one of the flanges 12 and 13 in such a manner that its position corresponds to the position of the drum rotational position sensor 85 when the clamping section 6 is located at the top in FIG. 1. This position is the fundamental position of the drum 2, where the drum can be stopped, the clamp board 5 of the clamping section 6 can be rotated, and the drum 2 can be loaded or unloaded.

As was described above, the stencil-making-type printing machine of the invention is provided with a plurality of rotary cylindrical drums having different printing regions such as a size-A3 drum having an ink passage region corresponding to sheet size A3, and a size-A4 drum having an ink passage region corresponding to sheet size A4. These drums are selectively used according to stencil printing operations to be performed. A mechanism for replacing a rotary cylindrical drum with another has been disclosed by Examined Japanese Patent Application Publication No's Sho. 62-28758 and Hei. 4-46236 in detail.

The drum support 121 which supports the drum 2, as shown in FIG. 2, has dip switches 133 and 135 which are turned on and off according to the size of the printing region of a given rotary cylindrical drum. The "on" and "off" states of those dip switches 133 and 135 may be combined to provide four modes. For instance, the dip switches 133 and 135 are both turned off for the size-A3 drum having a printing region corresponding to sheet size A3; and the dip switch 133 is turned off while the dip switch 135 is turned on for the size-A4 drum having a printing region corresponding to sheet size A4. That is, the four modes based on the "on" and "off" states of the dip switches are assigned to four rotary cylindrical drums different in printing region, respectively. In addition, the drum support 121 has an electrical connector 139 which is connected to an electrical connector 137 of the printing machine 1 when the drum 2 is loaded in the latter 1. Through those electrical connectors 137 and 139 thus connected together, data on the "on" and "off" state of the dip switches 133 and 135 is transmitted to a control system (described later) in the printing machine 1.

In the above-described embodiment, the dip switches 133 and 135 are employed to indicate the types of rotary cylindrical drums, and to detect data on the types of rotary cylindrical drums; however, they may be replaced by the following means. Different drum supports 121 which support different rotary cylindrical drums (different in printing region) are so designed to have a different number of slits, or slits at different positions, respectively; while the printing machine body has sensors in correspondence to the slits. In this case, when a rotary cylindrical drum 2 is loaded in the printing machine body, the specific type of drum can be determined from the slit which is detected by the sensor provided on the side of the printing machine body. In addition, the following means may be employed. That is, drum supports 121 supporting different rotary cylindrical drums 2 may have different bar codes, and the printing machine body may have a bar code reading device, so that when a rotary cylindrical drum 2 is loaded in the printing machine body, the bar code is read to identify the drum 2.

Referring back to FIG. 1, the stencil discharging section 50 has a stencil discharging claw 51. The claw 51 is pivotally mounted on a shaft 52, and its base end portion is coupled to a stencil-discharging-claw driving solenoid 53 so that the claw 51 may be rotated a predetermined angle about the shaft 52. More specifically, the stencil discharging claw 51 is rotatable between a stencil separating position where the front end portion of the claw 52 approaches the outer cylindrical surface of the drum 2 to separate the stencil from the latter 2, and a standby position which is spaced a predetermined distance from the drum 2.

The stencil S separated from the drum 2 is moved away from the latter 2, to the right of the stencil discharging claw 51. On the right side of the claw 51, a pair of stencil discharging rollers 56, or upper and lower rollers 54 and 55, are provided. The rollers are driven by a stencil conveying motor 83, to convey a stencil separated from the drum 2. Downstream of the pair of stencil discharging rollers 56, a used-stencil accommodating box 57 is provided to receive used stencils which are conveyed thereto by the pair of stencil discharging rollers 56. A used-stencil sensor 80 is provided on the left side of the pair of stencil discharging rollers 56, to detect the passage of the used stencil separated from the drum 2. The used-stencil sensor 80 is an optical sensor which comprises a light emitting section 58, and a light receiving section 59 provided below the former 58 to receive the output light of the light emitting section 58.

The stencil discharging section 50 has a box supporting stand 81 to set the used-stencil accommodating box 57 in position. The box supporting stand 81 has a box set sensor 82 including a limit switch and a reflection type sensor to detect whether or not the used-stencil accommodating box 57 is set in place.

The sheet supplying section 60 comprises a sheet supplying stand 61 on which printing sheets are stacked, the stand 61 being moved vertically by a vertical moving mechanism (not shown); pick-up rollers 62 for removing printing sheets from the sheet supplying stand 61 one at a time; a sheet supplying clutch 63 for controlling the transmission of the rotation of the main motor 3 to the pick-up rollers 62; and a pair of sheet conveying rollers 64 for feeding a printing sheet to the space between the drum 2 and the press roller 10 in a predetermined timing.

The sheet discharging section 70 comprises: a sheet separating claw 71 for separating a printed sheet P from the rotary cylindrical drum 2; a sheet discharging stand 72 on which printed sheets P are stacked; and a belt-conveyor-type printed-sheet conveying unit 73 which is adapted to convey the printed sheet P which has been separated from the drum 1 with the sheet separating claw 71 to the sheet discharging stand 72, and places it on the latter 72.

In the printing machine, the determination as to whether the used-stencil accommodating box 57 has been filled with used-stencils which have been separated from the drum and delivered thereinto by the stencil discharging section 50 is performed as follows.

As noted above, a printing stencil wound on the size-A3 drum 2 is different in length from a printing stencil wound on the size-A4 drum 2. Hence, whenever a used stencil is delivered into the used-stencil accommodating box 57, an addition is performed by using a numerical value corresponding to the length of the used stencil as addition data. When the result of addition reaches a predetermined value indicating that the used-stencil accommodating box has been filled with used stencils (hereinafter referred to as "fill-up reference data", when applicable), it is decided that the used-stencil accommodating box 57 has been filled, and the operator is notified by a display on the operating panel 150 (described later) of the printing machine.

For instance, in the case where the size-A3 drum 2 is loaded in the printing machine, the addition is performed as follows. When the used-stencil sensor 80 detects the passage of a used stencil which has been removed from the drum 2 by the stencil discharging section 50, the numerical value "7" corresponding to the length of the used stencil is used as addition data; that is, "7" is added to the latest result of addition. In the case where the size-A4 drum 2 is loaded in the printing machine, the numerical value "4" is added to the latest result of addition.

If, in this connection, it is assumed that the used-stencil accommodating box is filled with forty stencils which are of sheet size A3, then the fill-up reference data is 280 (7×40). Hence, in this case, the fill-up reference data is set to 280 in advance, and whenever a used stencil is discharged; that is, whenever the addition of the numerical value "7" or "4" is made, it is detected whether or not the result of addition reaches the fill-up reference data "280" indicating that the box is full.

The result of this addition, which is obtained in the above-described manner whenever a used stencil is discharged, is reset when the box set sensor 82 detects the removal of the used-stencil accommodating box 57 from the box supporting stand 81. When the box 57 is set on the box supporting stand 81, it is detected by the box set sensor 82, so that in the following used-stencil discharging operation, addition of the numerical value "4" or "7" is started from zero "0".

Figure 4:
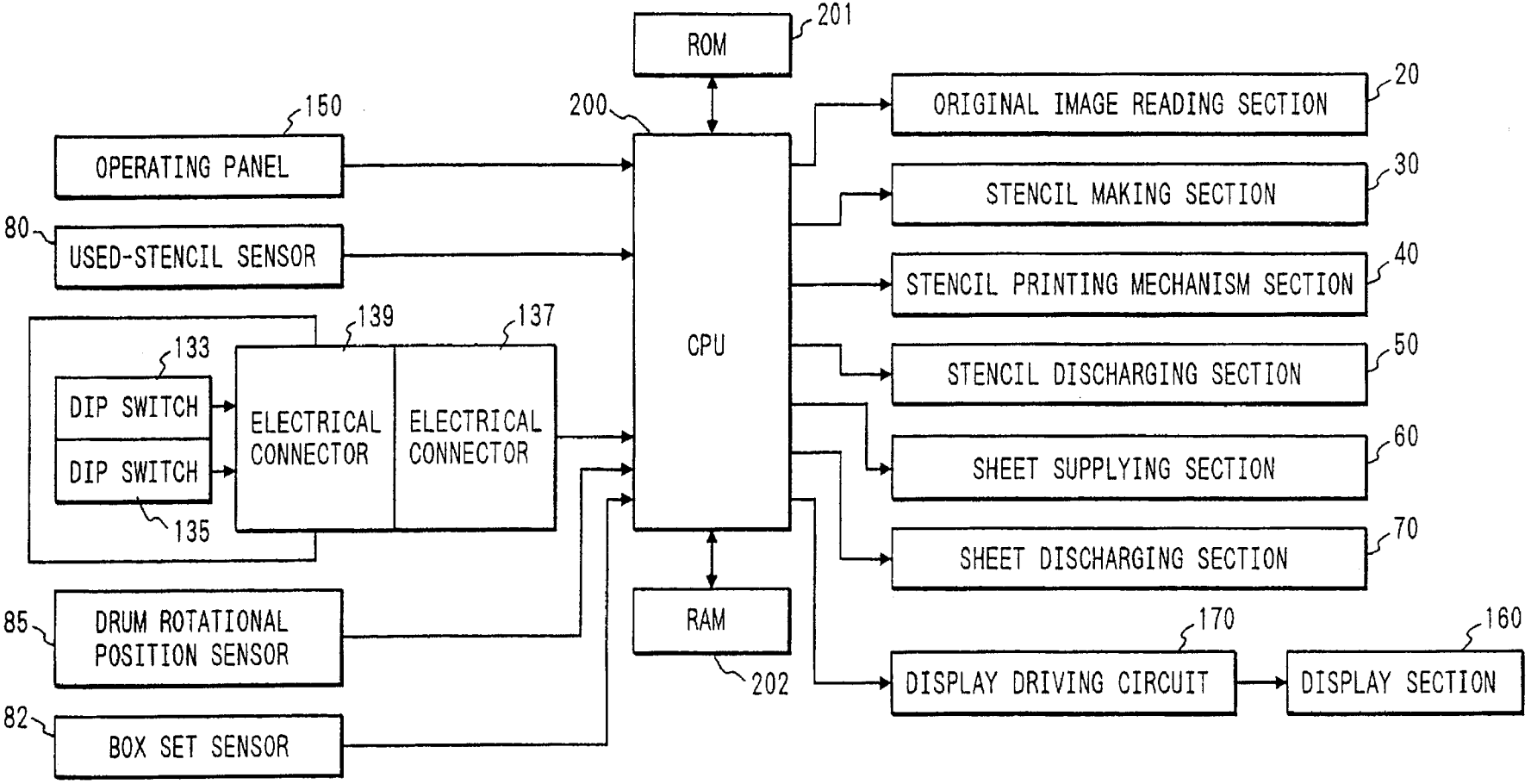
FIG. 4 is a block diagram showing the arrangement of an example of a control system of the printing machine.

FIG. 4 shows an example of a control system in the above-described stencil-making-type printing machine 1. The control system includes the above-described elements; namely, the original image reading section 20, the stencil making section 30, the stencil printing mechanism section 40, the stencil discharging section 50, the sheet supplying section 60, the sheet discharging section 70, the used-stencil sensor 80, the dip switches 133 and 135, the electrical connectors 137 and 139, the box set sensor 82, and the drum rotational position sensor 85. The control system further includes: a CPU 200 made up of a micro-processor; a ROM 201; and a RAM 202. The ROM 201 stores (1) a control program; comparison reference data on the basis of which the types of rotary cylindrical drums are indicated by the combinations of the "on" and "off" states of the dip switches 133 and 135—for instance the rotary cylindrical drum having a printing region corresponding to sheet size A3 is employed in the case where the dip switches 133 and 135 are both in "off" state, and the rotary cylindrical drum having a printing region corresponding to sheet size A4 is employed in the case where the dip switch 133 is in "off" state and the dip switch 135 is in "on" state; (2) the adding data corresponding to the lengths of printing stencils used separately according to the types of rotary cylindrical drums 2; and (3) the fill-up reference data provided separately according to the lengths of used stencils, to indicate when the used-stencil accommodating box is filled up with the printing stencils. The RAM 202 stores in a renewal mode input data, timer measurement values, and the result of addition which, whenever a used stencil is discharged, is made by using its addition data corresponding to the length of the used stencil to indicate the quantity of used stencils stored in the used-stencil accommodating box 57. The control system further includes an operating panel 150, a display section 160, and a display driving circuit 170. The operating panel 150 has mode setting keys for setting a stencil making mode and a printing mode, a ten-key board, start keys for starting a printing operation and a stencil making operation according to the modes set with the mode setting keys, and so forth. The display section 160 is made up of liquid crystals, to display when the used-stencil accommodating box 57 is filled, and to display various data concerning a stencil printing operation such as the number of prints to be outputted. The display driving circuit 170 controls the display of data which is displayed by the display section 160.

The control system operates as follows. Various data are received from the used-stencil sensor 80, the box set sensor 82, the drum rotational position sensor 85, the dip switches 133 and 135, and the operating panel 150. According to the control program and various data (such as the addition data and the fill-up reference data) stored in the ROM 201 it is detected whether or not the used-stencil accommodating box 57 is filled, the result of addition in the RAM 202 is renewed, and operating instructions are applied to the original image reading section 20, the stencil making section 30, the stencil printing mechanism section 40, the stencil discharging section 50, the sheet supplying section 60, the sheet discharging section 70, the display section 160, and the display driving section 170.

Figure 5:
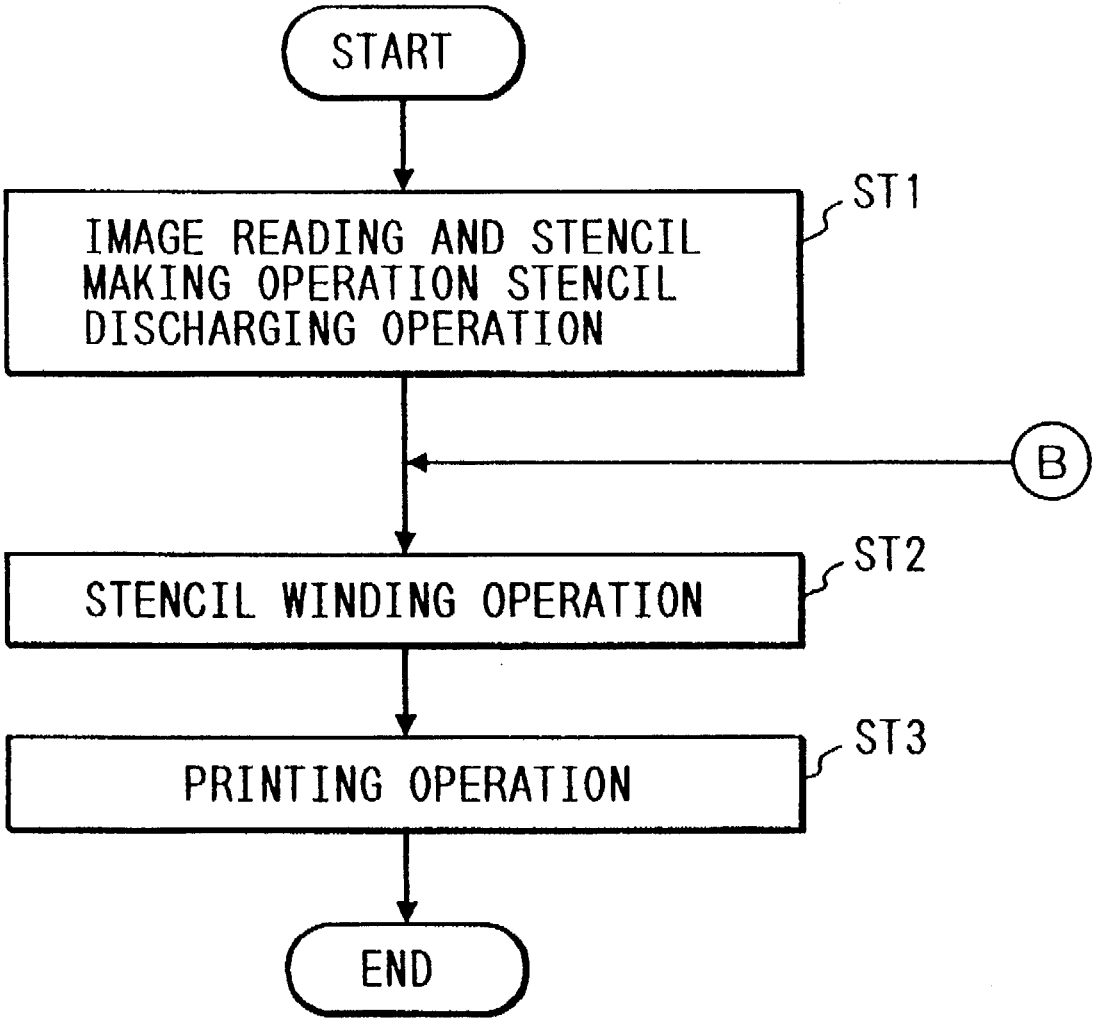
FIG. 5 is a flow chart relating to the operation of the printing machine.

The operation of the stencil-making-type printing machine thus organized will be described with reference to a flow chart of FIG. 5.

Upon depression of the start button in the stencil making mode, in the original image reading section 20 the image of a given original is read to provide image data, and in the stencil making section 30 the image of the original is perforated in a stencil paper S (provided in the form of a roll) according to the image data, to form a printing stencil. At the same time, the stencil discharging section 50 operates to separate the used stencil from the rotary cylindrical drum 2 and discharge it (Step ST1). After the used stencil has been discharged, the front end portion of the stencil paper S perforated in Step ST1 is secured to the drum 2 with the stencil clamping board 5, and under this condition the drum 2 is turned so that the stencil paper S is wound on the outer cylindrical surface of the drum 2. When the drum rotational position sensor 85 detects the passage of the shielding board 84 mounted on the edge of one of the flanges 12 and 13; that is, when it is detected that the drum 2 has rotated a predetermined angle, the stencil paper cutter 36 cuts the stencil paper S so that the printing stencil remains on the drum 2. Thus, the printing stencil has been wound on the drum 2 (Step ST2).

Next, in the printing mode, the number of prints to be formed is preset, and the start button is depressed. In response to the depression of the start button, the drum 2 is rotated. A printing sheet P, supplied from the sheet supplying section 60 in synchronization with the rotation of the drum 2, is pressed against the outer cylindrical surface of the drum 2, so that the printing ink supplied through the ink passage region of the drum 2 and the perforating region of the stencil is transferred onto the printing sheet P. The printing sheet P is separated from the drum 2 by the sheet discharging section 70, and delivered onto the sheet discharging stand 72 (Step ST3). The above-described printing operation is repeatedly carried out until the preset number of prints are obtained.

Figure 6:
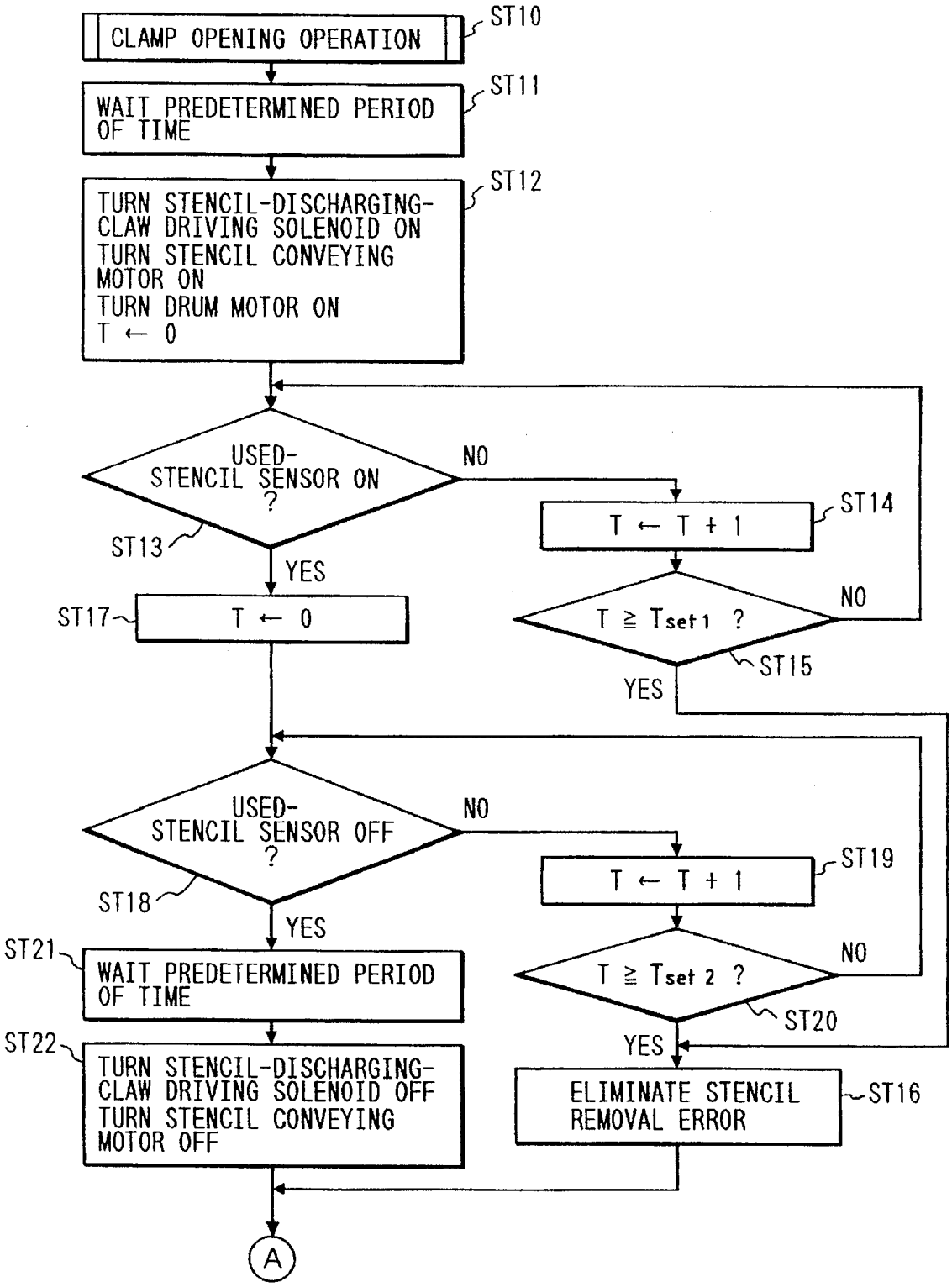
FIG. 6 is also a flow chart relating to the operation of a stencil discharging section in the printing machine.
Figure 7:
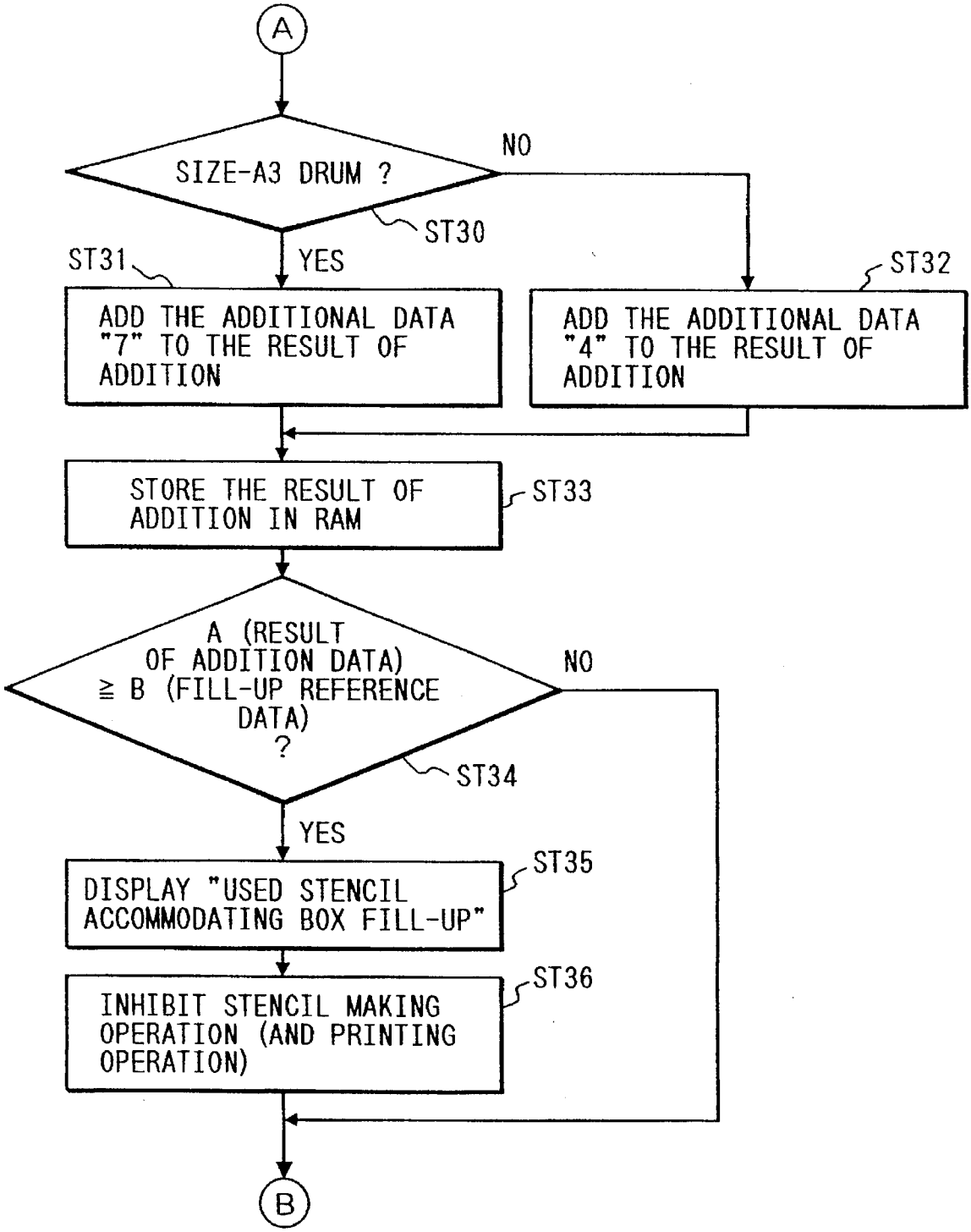
FIG. 7 is a flow chart relating to the operating steps which are taken to determine whether or not a used-stencil accommodating box is filled with used stencils.
Figure 8:
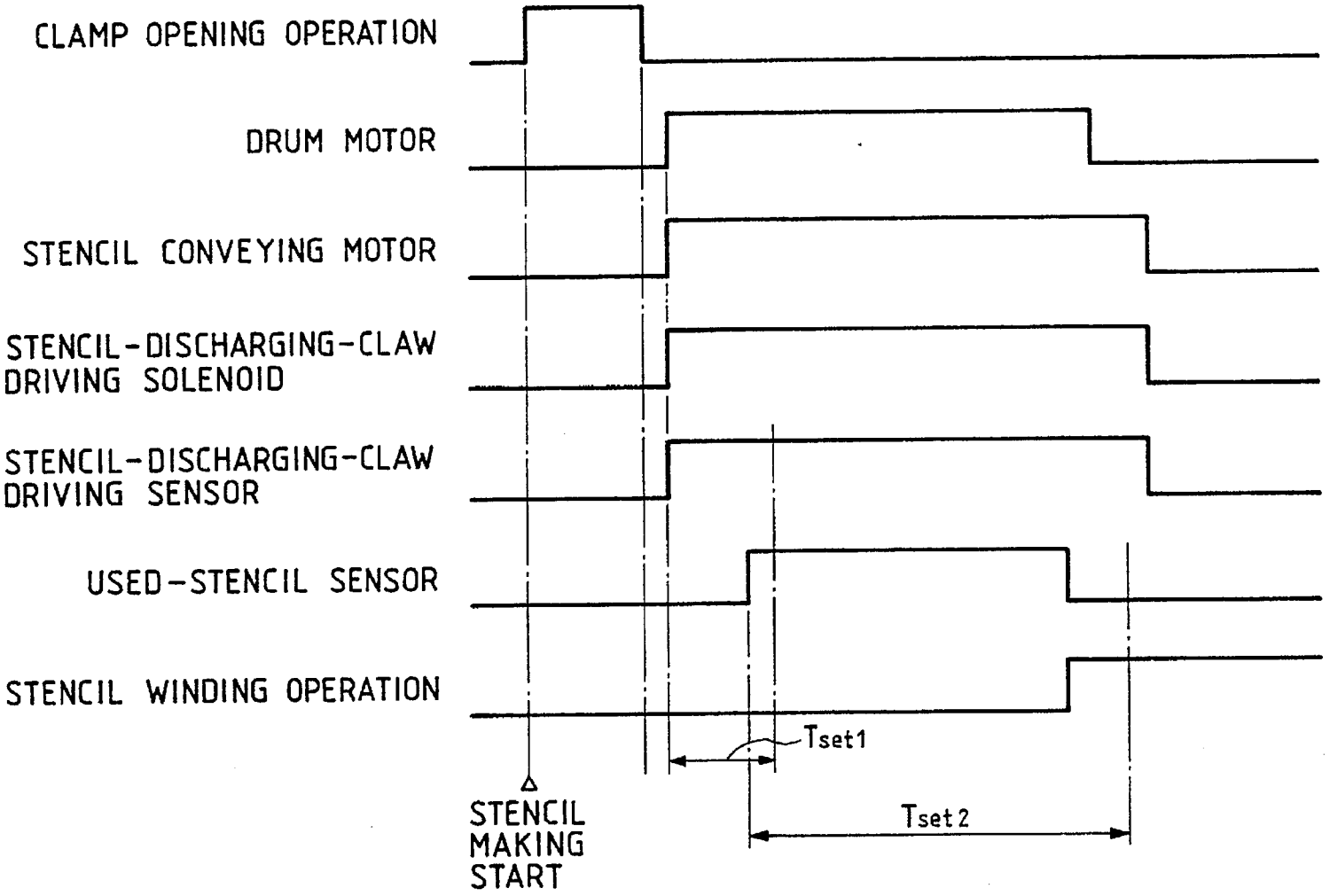
FIG. 8 is a time chart relating to the operation of the stencil discharging section in the printing machine.

Now, the operation of the stencil discharging section 50, and the control of the used-stencil accommodating box 57 will be described with reference to a flow chart shown in FIGS. 6 and 7 and a timing chart shown in FIG. 8.

The operation of the stencil discharging section 50 is started when the stencil making start button on the operating panel 150 is operated by the operator. First, the clamp solenoid 18 is activated so that the drive gear 19*a* is engaged with the gear 17 provided above the rotary cylindrical drum 2 which is held stopped at the initial rotational position. Under this condition, the clamp motor is operated to swing the stencil clamping board 5 to the clamp releasing position. That is, a clamp opening operation is carried out (Step ST10).

When, after the clamp opening operation, a predetermined period of time passes which is required for the drive gear 19*a* to disengage from the gear 17 with the aid of the clamp solenoid 18 (Step ST11), the stencil discharging operation is started.

In the stencil discharging operation, the stencil-discharging-claw driving solenoid 53 is activated to cause the stencil discharging claw 51 to move to the stencil separating position, and the stencil conveying motor 83 is rotated to rotate the pair of stencil discharging rollers 56, and the main motor 3 is rotated to turn the drum 2. In synchronization with those operations, in the CPU 200 the timer value is reset to "0" (Step ST12).

As a result, the used stencil S is removed from the drum 2 with the stencil discharging claw 51 as the drum 2 turns, and the used stencil thus removed is conveyed into the used-stencil accommodating box 57 while being held by the pair of stencil discharging rollers 56.

After the stencil discharging operation has been started in the above-described manner, it is determined whether or not the detecting state of the used-stencil sensor 80 is changed from the stencil absence state to the stencil presence state within a period of time, for instance two (2) seconds, which is predetermined from a timer set value $T_{SET1}$. That is, it is detected whether or not the output signal of the sensor 80 is changed from "off" level to "on" level (Steps ST13, ST14 and ST15).

In the case where the output signal of the used-stencil sensor 80 is not changed from "off" level to "on" level within the predetermined period of time, it is decided that, the used-stencil being jammed, its front end portion is not passed through the predetermined region in front of the pair of stencil discharging roller 56. In this case, a stencil removal error eliminating operation is carried out (Step ST16), and the starting of the following operation is inhibited, and an instruction is applied to the display drive circuit 170 to cause the display section 160 to display the fact that the stencil has been removed in an unacceptable manner.

On the other hand, in the case where the output signal of the used-stencil sensor 80 is changed from "off" level to "on" level within the predetermined period of time, it is decided that the front end portion of the used stencil is passed through the predetermined region in front of the rollers 56; that is, the used stencil is correctly discharged. In this case, in the CPU 200, the timer value T is reset to zero (0) (Step ST17). Thereafter, it is determined whether or not the detecting state of the used-stencil sensor 80 is changed from the stencil presence state to the stencil absence state within a period of time, for instance ten (10) seconds, from the next time instant which is predetermined according to a timer set value $T_{SET2}$; that is, in this case, it is determined whether or not the output signal of the used-stencil sensor 80 is set to "off" level from "on" level (Steps ST18, ST19 and ST20).

In the case where, after being raised to "on" level, the output signal of the used-stencil sensor 80 is not set to "off" level within a period of time which is determined from the timer set value $T_{SET2}$, it is decided that, the used stencil is for instance jammed, and its rear end portion does not pass through the predetermined region in front of the pair of stencil discharging roller 56. In this case, the stencil removal error eliminating operation is carried out, the starting of the following operation is inhibited, and an instruction is applied to the display drive circuit 170 to cause the display section 160 to display the fact that the stencil has been removed in an unacceptable manner.

On the other hand, in the case where, after being raised to "on" level, the output signal of the used-stencil sensor 80 is changed to "off" level within the period of time which is determined according to the timer set value $T_{SET2}$, it is decided that the rear end portion of the stencil has passed through the predetermined region in front of the rollers 56; that is, the stencil has been correctly discharged.

When a predetermined period of time, for instance about two (2) seconds, passes from the time instant that the output signal of the used-stencil sensor 80 is set to "off" level (Step ST 21), the stencil-discharging-claw driving solenoid 53 is turned off to retract the stencil discharging claw 51, and the stencil conveying motor 83 is turned off to stop the rotation of the pair of stencil discharging rollers 56. Thus, the stencil discharging operation has been accomplished (Step ST22).

When, after the stencil discharging operation, it is determined from the on-off data of the dip switches 133 and 135 that the size-A3 drum 2 is loaded in the printing machine body ("Yes" in Step ST30), the CPU 200 operates to add the addition data "7" corresponding to the length of the stencil formed for sheet size A3 to the result of addition which has been stored in the RAM 202 (Step ST31), to obtain the latest result of addition. The latest result of addition thus obtained is stored, in a renewal mode, in the RAM 202 in response to a write instruction signal from the CPU 200 (Step ST33).

When, on the other hand, it is determined from the on-off data of the dip switches 133 and 135 that the size-A4 drum 2 is loaded in the printing machine body ("No" in Step ST30), the CPU 200 operates to add the addition data "4" corresponding to the length of the stencil formed for sheet size A4 to the result of addition which has been stored in the RAM 202 (Step ST32) to obtain the latest result of addition. Similarly as in the above-described case, the latest result of addition thus obtained is stored, in a renewal mode, in the RAM 202 in response to a write instruction signal from the CPU 200 (Step ST33).

Under this condition, the CPU 200 operates to compare the latest result of addition stored in the RAM 202 with the fill-up reference data stored in the ROM 201 which is used to determine whether or not the used-stencil accommodating box 57 is filled with used stencils. When it is determined that the latest result of addition is equal to or larger than the fill-up reference data ("Yes" in Step ST34), the CPU controls the display drive circuit 170 to cause the display section 160 to display the fact that the used-stencil accommodating box 57 is filled with used stencils (ST35). Thereafter, the CPU inhibits the stencil making operation (and the printing operation) (ST36), and starts the stencil winding operation shown in FIG. 5 (Step ST2).

On the contrary, when it is determined that the latest result of addition is smaller than the fill-up reference data ("No" in Step ST34), it is concluded that the used-stencil accommodating box is not filled up. The CPU starts the stencil winding operation shown in FIG. 5 (Step ST2).

In summary, the control system operates as follows. When a rotary cylindrical drum 2 is loaded in the printing machine body, the CPU 200 operates to detect the type of the drum 2 from the on-off data of the dip switches 133 and 135. When it is detected by the used-stencil sensor 80 that a used stencil is delivered into the used-stencil accommodating box, the CPU 200 operates to add the numerical value corresponding to the length of the used stencil (which is determined from the type (size) of the drum 2) to the result of addition which has been stored in the RAM 202, to obtain the latest result of addition, and compares the latest result of addition thus obtained with the fill-up reference data to determine whether or not the used-stencil accommodating box is filled up with used stencil. Hence, even if, in the printing machine, the rotary cylindrical drums 2 having printing regions which are different in size from one another are frequently replaced with one another, it can be accurately detected whether or not the used-stencil accommodating box is filled.

When it is determined that the latest result of addition is equal to or larger than the fill-up reference data, the CPU 200 applies a signal to warning means, namely, the display section 160 to cause the latter 160 to display the fact that the used-stencil accommodating box 57 is filled up with used stencil, thereby to notify the operator. The warning means may be a circuit which outputs a buzz or voice. If the circuit is used in combination with the display section, then the fact that the used-stencil accommodating box is filled up with used stencils can be notified to the operator more positively.

The box supporting stand 81, on which the used-stencil accommodating box 57 is set, is provided with the box set sensor 82 which is adapted to detect whether or not the box 57 is set in position. Hence, when the box 57 is removed from the stand 81, the sensor 82 outputs a detection signal, which is utilized to reset the result of addition stored in the RAM 202. When the box 57, after being emptied, is set on the stand 81 again, the box set sensor 82 outputs a detection signal. The detection signal is applied to the CPU 200, so that the stencil-making-type printing operation is started again.

In order to detect with higher accuracy whether or not the used-stencil accommodating box is filled up with used stencils, the control system may be modified as follows. Stencil detecting means for detecting the presence or absence of a stencil in the used-stencil accommodating box 57 may include a light emitting element E and a light receiving element R (see FIG. 1). When the CPU 200 receives the detection signal which the box set sensor 82 outputs when the used-stencil accommodating box 57, after being removed from the box supporting stand 81, is set correctly on the latter 81 again, and the detection signal which the stencil detecting means outputs when no stencil is present in the used-stencil accommodating box 57, the result of addition stored in the RAM 202 is reset. In this case, it can be determined more accurately whether or not the used-stencil accommodating box is filled up with used stencils.

In the case where, as was described above, the result of addition is reset in response to the detection signal which the box set sensor 82 outputs when the used-stencil accommodating box 57 is removed from the box supporting stand, the control system may be operated relatively frequently for removal and accommodation of used stencils. However, this difficulty may be eliminated by the following method: only when the CPU 200 receives the detection signal Which the box set sensor 82 outputs when the used-stencil accommodating box 57 is set correctly on the box supporting stand 81 again, and the detection signal which the stencil detecting means outputs when no used stencil is present in the used-stencil accommodating box 57, the stencil-making-type printing operation is started again. Employment of this method eliminates the difficulty that the control system is operated excessively for removal and accommodation of used stencils, and makes it possible to remove and accommodate the used stencils more positively.

The rotary cylindrical drums 2 are rotatably supported by their own drum supports 121. Each of the drums 2 together with its own drum support 121 is replaceably loaded in the printing machine body, and the drum support 121 has its own information providing section to indicate the type of drum 2 supported thereby. That is, the information providing sections of the different drum supports 121 provide different pieces of information, so that the rotary cylindrical drums 2 different in type (printing region size) can be separately set up.

Each information providing section is made up of two dip switches 133 and 135 having switching states which are selected according to the type (printing region size) of the corresponding drum 2. That is, a plurality of rotary cylindrical drums different in type can be separately set up by combination of the switching states of the dip switches 133 and 135.

The shielding board 84, which is detected by the drum rotational position sensor 85, is detachably mounted on the flange of the drum 2. Hence, by shifting the position of the shielding board 84, the length to which the stencil paper S should be cut to form a printing stencil can be changed most suitably for the given rotary cylindrical drum 2; in other words, the length of the printing stencil can be minimized according to the size of the printing region of the drum 2. This means that the stencil paper S is economically used.

In the above-described embodiment, the drum rotational position sensor 85 is fixedly provided on the side of the printing machine body, and the shielding board 84 is detachably mounted on the flange 12 (or 13) of the drum 2; however, the invention is not limited thereto or thereby. That is, the printing machine may be so modified that the shielding board 84 is provided on the side of the printing machine, and the sensor 85 is detachably mounted on the flange 12 (or 13) of the drum 2. It goes without saying that the modification has the same effect.

The stencil-making-type printing machine according to the invention has the following effects or merits. Even if replacement of the rotary cylindrical drum is frequently carried out; that is, even if used stencils different in length are discharged at random, it can be detected with high accuracy when the used-stencil accommodating box is filled with used stencils, and it can be notified to the operator.

According to the invention, it is detected whether or not the used-stencil accommodating box is at the predetermined position. Therefore, in response to the detection signal which is provided when the used-stencil accommodating box is removed from the predetermined position, the result of addition which has been stored in the memory means can be reset.

Additionally, the result of addition which has been stored in the memory means is reset in response to both the detection signal which is provided when the used-stencil accommodating box is removed from the predetermined position and the detection signal which the stencil detecting means outputs when no used stencil is present in the used-stencil accommodating box. Hence, it can be detected with higher accuracy whether or not the used-stencil accommodating box is filled up with used stencils.

Each rotary cylindrical drum is rotatably supported by its own drum support, and is replaceably loaded in the printing machine body together with the drum support. The drum support has the information providing section which indicates the type of the rotary cylindrical drum. Hence, by allowing the different information providing sections of the different drum supports to provide different pieces of information, the rotary cylindrical drums different in type (printing region size) can be separately set up.

Each information providing section is made up of the dip switches having switching states which are selected according to the type (printing region size) of the rotary cylindrical drum. Hence, the different rotary cylindrical drums can be separately set up by combination of the switching states of the dip switches.

The shielding member is detachably mounted on the peripheral edge of the rotary cylindrical drum. Hence, by shifting the position of the shielding member, the length to which the stencil paper should be cut can be suitably set according to the rotary cylindrical drum loaded in the printing machine; that is, the length can be minimized. As a result the stencil paper is used economically.

What is claimed is:

1. In a stencil-making-type printing machine in which plural types of rotary cylindrical drums having printing regions of different sizes can be loaded one at a time, in which a stencil paper provided in the form of a roll is cut according to the printing region of a rotary cylindrical drum loaded therein to form a printing stencil, and a printing operation is carried out with said printing stencil wound on said rotary cylindrical drum, and before a printing operation is carried out for a new original, a used stencil is separated from said rotary cylindrical drum and discarded into a used-stencil accommodating box, the improvement comprising:

drum type detecting means for detecting the type of a rotary cylindrical drum loaded in said machine;

memory means for storing as addition data a numerical value corresponding to the length of a used stencil which is discarded in said used-stencil accommodating box;

control means which adds addition data corresponding to the length of a used stencil which is separated from a rotary cylindrical drum the type of which is detected by said drum type detecting means, to the result of the previous addition, to obtain the latest result of addition, causes said memory means to store the latest result of addition thus obtained, and determines whether or not the latest result of addition reaches a predetermined value; and notifying means which, when the latest result of addition reaches said predetermined value, makes notification of the fact that said used-stencil accommodating box is filled up with used stencils.

2. A printing machine as claimed in claim 1, further comprising:

box detecting means for detecting whether said used-stencil accommodating box is at a predetermined position, wherein said control means operates to reset, in response to a detection signal which said box detecting means outputs when said used-stencil accommodating box is removed from said predetermined position, the result of addition which has been stored in said memory means.

3. A printing machine as claimed in claim 1, further comprising:

box detecting means for detecting whether said used-stencil accommodating box is at a predetermined position, and stencil detecting means which, when said used-stencil accommodating box is set at said predetermined position, determines whether or not a used stencil is present in said used-stencil accommodating box, wherein said control means operates to reset, in response to both a detection signal which said box detecting means outputs when said used-stencil accommodating box is removed from said predetermined position and a detection signal which said stencil detecting means outputs when no used stencil is present in said used-stencil accommodating box set at said predetermined position, the result of addition which has been stored in said memory means.

4. A printing machine as claimed in claim 1, wherein, each rotary cylindrical drum is rotatably supported by a respective drum support, and is replaceably loaded in said printing machine together with said drum support, said drum support having an information providing section which indicates the type of said rotary cylindrical drum, so that the type of said rotary cylindrical drum is identified from information given by said information providing section.

5. A printing machine as claimed in claim 4, wherein said information providing section provided for said drum support comprises dip switches having switching states which depend on the type of said rotary cylindrical drum.

6. A printing machine as claimed in claim 1, further comprising:

a shielding member detachably mounted on a peripheral edge of each rotary cylindrical drum; and shielding-member detecting means for detecting the passage of said shielding member as said rotary cylindrical drum turns, wherein said control means operates to cut said stencil paper in response to a detection signal which said shielding-member detecting means outputs upon detection of the passage of said shielding member.

7. A printing process comprising the following steps:

(a) loading one of plural types of rotary cylindrical drums having printing regions of different sizes in a printing machine;

(b) detecting the type of said one cylindrical drum loaded in said machine;

(c) conveying a stencil paper to said one loaded drum;

(d) cutting said stencil paper to a size corresponding to the printing region of said one cylindrical drum loaded in said loading step;

(e) performing a printing operation with said stencil paper wound on said rotary cylindrical drum so as to print an image on at least one sheet of paper corresponding in size to said size of said printing region;

(f) separating said stencil paper from said rotary cylindrical drum and discarding said stencil paper as a used stencil paper into a used-stencil accommodating box disposed at a predetermined position;

(g) storing as addition data a numerical value corresponding to the length of said used stencil paper which is discarded in said accommodating box;

(h) optionally replacing said one drum with another drum and detecting the size of said another drum;

(i) sequentially performing said steps (c) through (h) and adding addition data corresponding to the length of said used stencil paper which is sequentially separated to the result of the previous addition, to obtain a latest result of addition;

(j) comparing said latest result of addition with a predetermined value; and (k) notifying when said latest result of addition reaches said predetermined value indicating that said accommodating box is full.

8. The printing process as claimed in claim 7, further comprising the step of:

(l) detecting whether said used-stencil accommodating box has been emptied and replaced at said predetermined position; and (m) resetting said result of addition upon said detection in said step (l).

* * * * *